United States Patent [19]

Stahlecker

[11] Patent Number: 4,833,757

[45] Date of Patent: May 30, 1989

[54] MOUNTING FOR AN OPENING ROLLER

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany

[21] Appl. No.: 237,330

[22] Filed: Aug. 29, 1988

[30] Foreign Application Priority Data

Sep. 10, 1987 [DE] Fed. Rep. of Germany ..... 3730297

[51] Int. Cl.[4] ..... D01G 15/14; D01H 7/895

[52] U.S. Cl. ..... 19/97; 19/112; 57/408

[58] Field of Search ..... 57/408; 19/97, 105, 19/107, 112, 144

[56] References Cited

U.S. PATENT DOCUMENTS

| | | | |
|---|---|---|---|
| 4,135,355 | 1/1979 | Stewart | 57/408 |
| 4,272,865 | 6/1981 | Schmolke | 19/97 |
| 4,291,437 | 9/1981 | Yoshizawa et al. | 57/408 X |
| 4,301,572 | 11/1981 | Miyamoto | 19/112 X |
| 4,352,224 | 10/1982 | Grimshaw et al. | 19/97 |
| 4,435,953 | 3/1984 | Schmid et al. | 57/408 |
| 4,646,389 | 3/1987 | Stahlecker et al. | 19/97 |

*Primary Examiner*—Donald Watkins

*Attorney, Agent, or Firm*—Barnes & Thornburg

[57] ABSTRACT

In the case of a mounting for opening rollers having a plurality of teeth, it is provided that the lateral profiles of the teeth are located in essentially radial surfaces, and that, not before the area of the tip, at least one lateral profile has an end area which extends to the other lateral profile and is inclined with respect to the radial plane.

13 Claims, 2 Drawing Sheets

MOUNTING FOR AN OPENING ROLLER

BACKGROUND AND SUMMARY OF THE INVENTION

The invention relates to a mounting or toothed fitting for an opening roller having a plurality of teeth, each tooth having a tooth throat, a tooth face and a back as well as lateral profiles located between the back and the tooth face which approach one another to form a tip.

Basically two types of mountings are known which differ by how they are produced. In the case of one construction German Published Application (DE-) No. 34 39 664 (see also related commonly owned pending U.S. application Ser. No. 191,402, filed May 9, 1988 as a continuation-in-part of application Ser. No. 793,122, filed Oct. 30, 1985), the teeth are machined directly, particularly by means of grinding, into the circumference of the opening roller or into the circumference of a ring mounting or fitting fitted onto the opening roller. In the case of the other construction (U.S. Pat. No. 4,169,019), a so-called card wire is wound around the opening roller in a spiral shape. In both constructions, it is provided that the teeth, viewed against their travel direction, taper from the inside toward the tooth tip, i.e., the lateral profiles approach one another at a constant slope. As a result, relatively pointed teeth are created which can penetrate very well into the fiber material to be opened up by combing-out. Thus relatively slender teeth are obtained. However, teeth of this type are very soft and can be elastically and plastically bent relatively easily. After a bending, there will be the danger that the functioning may be impaired. In addition, an elastic bending often results in a chipping-off and detaching of the coating that is applied to the teeth and is less elastic. As a result the durability of the mounting is reduced significantly.

In the case of porcupine rollers for combing arrangements, i.e., in the case of a different type, it is known from German Published Unexamined Application (DE-OS) No. 20 24 357 to provide the circumference of one roller with recesses into which rows of needles are inserted. In this case, it is known to have the tooth-like projections taper with a rounding continuously from the tooth throat to the tooth tip.

Other commonly assigned patents and patent applications which relate to opening roller constructions include (i) pending U.S. application Ser. No. 196,688, which is a continuation-in-part of U.S. application Ser. No. 088,973, filed Aug. 24, 1987, which is in turn a continuation of application Ser. No. 731,272, filed May 7, 1985; (ii) U.S. Pat. No. 4,646,389; and (iii) U.S. Pat. No. 4,715,777.

See also commonly assigned U.S. patent application Ser. No. 237,760, filed Aug. 29, 1988, based on German Patent Application No. P 37 30 295.7, filed in Germany on Sept. 10, 1978.

An object of the invention is to provide a toothed fitting of the initially mentioned type in which the teeth have a higher stability without the disadvantages concerning their functioning.

This object is achieved according to preferred embodiments of the invention in that the lateral profiles are located in essentially radial surfaces, and in that at least one lateral profile has an end area that approaches the other lateral profile and is inclined toward the radial plane only at the radially outer tip area.

Thus, a tooth shape is created by means of which the teeth are provided with a larger thickness transversely to their travel direction, whereby they become more resistant to bending in this direction. The tip itself, in this case, is developed to be sufficiently pointed so that the penetration into the fiber material is not impaired.

In an advantageous embodiment of the invention, it is provided that the lateral profiles, up to at least approximately ⅔ of the radial height of the teeth, are developed as essentially radially aligned surfaces. Thus, relatively stable teeth can be created.

In a further development of preferred embodiments of the invention, it is provided that the angle between the lateral profiles in the area of the tooth tips is between 35° and 50°. As a result, tooth tips are created which are sufficiently sharp or pointed in order to easily dip into the fiber material.

Other objects, advantages and novel features of the present invention will become apparent from the following detailed description of the invention when considered in conjunction with the accompanying drawings.

DETAILED DESCRIPTION OF THE DRAWINGS

Figure 1:
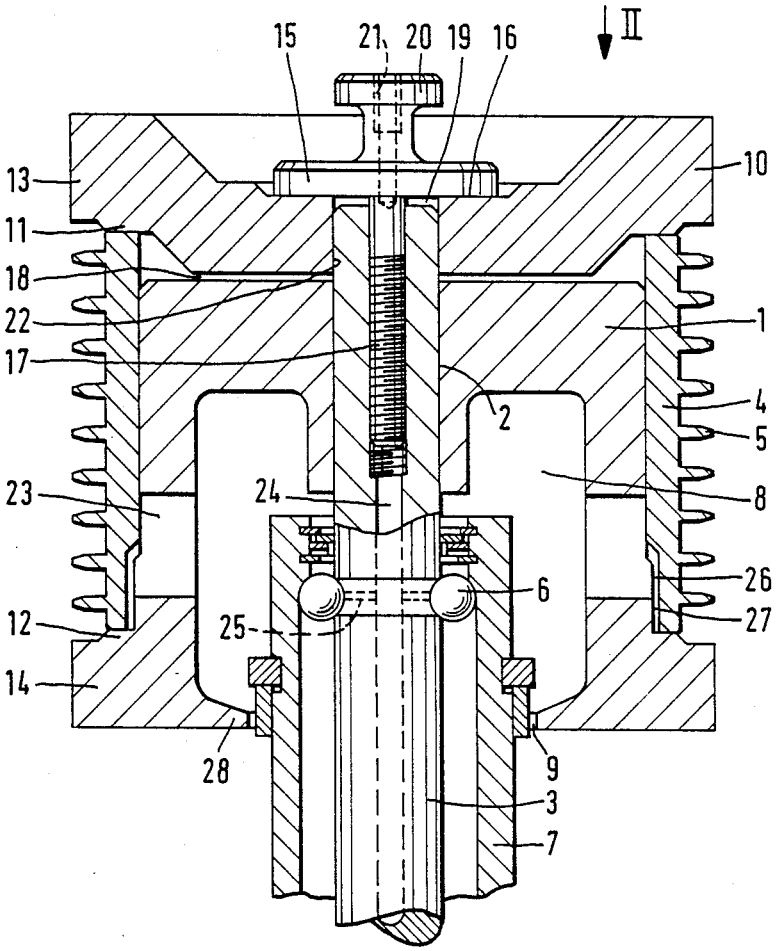
FIG. 1 is a longitudinal sectional view of an opening roller which is equipped with a ring mounting having teeth, constructed in accordance with a preferred embodiment of the invention.

The opening roller shown in FIG. 1 has a shaft 3 which is supportively rotatably disposed in a bearing housing 7 by means of two roller bearings, of which only bearing 6 is shown. On both sides, the shaft 3 projects beyond the bearing housing 7. At the end that is not shown in the drawing, the shaft 3 is equipped with a driving wharve.

The end of the shaft 3 that is shown in the drawing is equipped with the actual opening roller construction. A base body 1 having a bore 2 is slid onto the shaft 3 in a press fit. The axial position of the base body 1 may be fixed by a collar or a retaining ring or the like in the direction toward the bearing housing 7. The base body 1 has a cylindrical circumferential surface which is limited in the axial direction by a collar 14. A ring fitting or mounting 4 is slid onto the cylindrical circumferential surface of the base body (1) by means of a sliding fit. The ring mounting 4 is equipped with a mounting consisting of a plurality of teeth 5 which will be discussed in detail in the following. These teeth 5 are machined into the ring mounting 4 by means of cutting.

The base body 1, in the area of the flange 14, is equipped with a collar 27, to which a slightly larger-dimensioned recess 26 of the ring mounting 4 is assigned. As a result, it is ensured that the ring mounting 4, only in a certain position, can be slid onto the base body 1 into the end position.

The ring mounting 4 is braced against the flange 14 by means of a saucer-like indented disk 10. The disk 10, with its edge, supports itself against the end of the ring mounting 4 that axially projects beyond the base body 1. The disk 10 is fitted onto the shaft 3 by means of a bore 22. It is fastened at the shaft 3 by means of a tensioning screw 17 which is screwed or threaded into the shaft 3 and, with a flange 15, supports against the gripping surface 16 of the disk 10. The thickness of the disk 10 is dimensioned such that it projects over the end of the shaft 3 projecting out of the base body 1. In addition, the disk 10 is shaped such that a sufficient play 18 remains with respect to the base body 1 in order to permit a bracing of the ring mounting 4.

The flange 14 of the base body 1, like the edge 13 of the disk 10, projects in the radial direction at least into the area of the tips of the teeth 5. The interior sides of the edge 13 and of the flange 14, which face one another, are provided with thickenings 11, 12 so that the flange 14 and the edge 13 start, in each case, at a distance in the axial direction with respect to the adjacent teeth 5 which corresponds approximately to the axial distance of the teeth 5 with respect to one another.

The base body 1, by means of a hollow space 8, surrounds the end of the bearing housing 7 equipped with the roller bearing 6. In this case, the base body 1, at its end which extends over the bearing housing 7, is equipped with a collar 28 projecting toward the inside, this collar 28 being disposed opposite a sealing ring mounted at the bearing housing 7 and forming a sealing gap 9 together with it. The hollow space 8 is made accessible via bores 23 of the base body 1 to cleaning tools, such as a blowing nozzle, after the disk 10 is removed and the ring mounting 4 is shifted axially at least so far that the bores 23 are exposed.

Via the bore 24, into which the screw 17 is screwed, lubricant can be supplied via radial bores 25 branching off from axial bore 24 for the roller bearings 6. The screw 17 is constructed in the manner of an undercut gripping head 20 which has a central recess 21 for the application of a tool, such as a hexagon socket.

Figure 2:
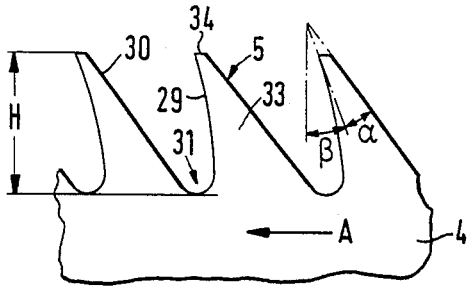
FIG. 2 is an enlarged lateral view taken in the direction of the Arrow II of FIG. 1 and showing the teeth of the ring mounting.
Figure 3:
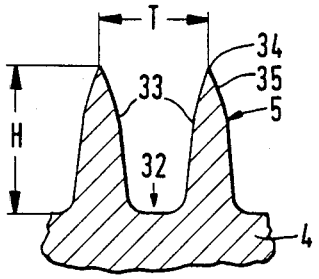
FIG. 3 is an approximately axial partial sectional view of the teeth of the mounting of FIG. 1 and 2.

In FIGS. 2 and 3, the teeth 5 of the ring mounting 4 are shown in an enlarged scale. The teeth 5 each have a very wide tooth throat, by means of which they emerge out of the base material of the ring mounting 4. They have a tooth face 29 pointing toward the front in the travel direction (A) of the ring mounting 4, and a back 30. As shown in FIG. 2, the back 30 of the teeth 5 extends approximately in a straight line, while the tooth face 29 is curved in an approximately crescent-shaped manner. The tooth face 29 of the tooth 5 which follows merges into the back 30 of the preceding tooth in the area of the tooth throats with a rounding 31 which starts tangentially at the back 30 and tapers out gently into the tooth face 29.

Between the tooth face 29 and the back 30, the teeth 5 have a vertical angle ($\alpha$) which is relatively pointed and is of a magnitude of between 15° and 33°. The tooth face 29, with respect to a radial line through the axis of rotation of the ring mounting 4, has a front angle ( which is between 12° and 25°. As a result of the fixing of the vertical angle ($\alpha$) and of the front angle ($\beta$), the tooth shape—viewed in axial direction of the ring mounting 4—is largely fixed. As shown in FIG. 2, the tooth tip 34 is slightly leveled or flattened.

FIG. 3 shows that the teeth 5 have a relatively large radial height (H) which is larger than the distance (T) between two teeth that are adjacent in the axial direction. In order to create, despite the above-described relatively acute angles ($\alpha$ and $\beta$), teeth 5 that are as resistant to bending as possible, it is provided that the lateral profiles 33 located between the tooth face 29 and the back 30 are developed such that the teeth 5 of the ring mounting 4 have a thickness in the axial direction that is as large as possible. As shown in FIG. 3, the lateral profiles 33 are constructed such that up to approximately $\frac{2}{3}$ of the height (H), they extend almost in a radial plane or only at a relatively small angle of only a few degrees with respect to it. It is only after approximately $\frac{2}{3}$ of the height (H) that the lateral profiles 33 approach one another at an acute angle with an end area 35 that is sloped significantly more with respect to the radial plane, until they converge in the area of the tip 34. Therefore an angle is obtained in this direction between the inclined end areas 35 of the lateral profiles 33 that is of a magnitude of 35° to 50°, and preferably approximately 45°. As a result, a cutting-edge-type chamfering of the tooth tip 34 is obtained which permits a good penetrating into a fiber material, without having to develop the teeth 5 themselves very slender over their overall height. As also shown in FIG. 3, relatively deep, U-shaped grooves 32 are formed between the lateral profiles 33. In the case of the embodiment according to FIG. 3, it is provided that the end areas 35 having a more extensive inclination connect to the areas of the lateral profiles 33 that are located farther inside in the radial direction via a curve.

The teeth 5 of the ring mounting 4 are machined out of the initially massive ring mounting 4, by means of cutting, particularly by means of turning and grinding. In this case, grooves are worked into the exterior side of the ring mounting 4 which extend in the circumferential and axial directions. In the process, the tooth face 29 of the teeth 5 is worked such that, by means of roundings, it merges into the lateral profiles 33. Preferably, such a rounding is also provided in the area of the backs 30. As a rule, the teeth 5 are provided with a coating, particularly with a chemically applied nickel diamond coating. As a result of the reinforced shape of the teeth 5, it is achieved that they bend less easily so that the danger is reduced that the coating chips off the teeth 5.

Figure 4:
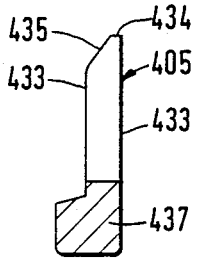
FIG. 4 is a partial axial sectional view of another embodiment having a mounting that is developed as card wire.

As shown in FIG. 4, the basic principle according to the invention can also be applied in the case of a mounting made of a card wire, in which case, a card wire corresponding to FIG. 4 is, for example, wound onto the outer circumference of an opening roller or of a ring mounting 4. The card wire has a throat area 437 which is mounted at the outer circumference of the corresponding rotating body (or alternatively in grooves) and from which the teeth 405 project upward or radially outward. The teeth 405 have lateral profiles 433 which extend essentially in radial planes, one of these profiles extending as a smooth and straight surface from the inside to the tooth tip 434. The other lateral profile 433, in the area of the last quarter of the height of the tooth, is provided with an end area 435 which approaches the other lateral profile diagonally , this end area 435, together with this tooth profile 433 forming a cutting-edge-type tip 434. In the case of this embodiment, the end area 435, via an edge, adjoins the area of the lateral profile 433 that is located essentially in a radial plane. As shown in FIG. 4, the tip 434 is slightly dulled, by means of a flattening, so that there is no danger that the fibers of the fiber material to be opened up are cut when the teeth 405 dip in. In a similar manner, a flattening is advantageously also provided in the case of the embodiment according to FIGS. 2 and 3.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A mounting for an opening roller having a plurality of teeth, each tooth having a tooth throat, a tooth face, a tooth back, and lateral profiles between the tooth back and the tooth face which approach one another to form tip, wherein the lateral profiles of the teeth are located in essentially radial planes, and wherein at least one lateral profile has an end area which commences adjacent the area of the tip and which extends toward the other lateral profile and is inclined with respect to the radial plane.

2. A mounting according to claim 1, wherein the lateral profiles are formed as essentially radially aligned surfaces, up to at least approximately $\frac{2}{3}$ of the radial height of the teeth.

3. A mounting according to claim 1, wherein the inclined end area or areas of the lateral profiles adjoin the areas that are aligned essentially radially via an edge.

4. A mounting according to claim 1, wherein the inclined end area or areas of the lateral profiles, merge into the essentially radially aligned areas via a rounding.

5. A mounting according to claim 1, wherein the angle between the lateral profiles, in the area of the tooth tip, is between 35° and 50°.

6. A mounting according to claim 1, wherein one lateral profile extends, as a straight surface, essentially in radial direction, and only the other lateral profile has an end area which is directed diagonally toward the radial plane, in the area of the tip.

7. A mounting according to claim 1, wherein the teeth are flattened in the area of the tips.

8. A mounting according to claim 1, wherein the tooth face of the teeth merges into the lateral profiles via a rounded section.

9. A mounting according to claim 1, wherein the teeth are provided with a hardened coating.

10. A mounting according to claim 2, wherein the angle between the lateral profiles, in the area of the tooth tip, is between 35° and 50°.

11. A mounting according to claim 2, wherein one lateral profile extends, as a straight surface, essentially in radial direction, and only the other lateral profile has an end area which is directed diagonally toward the radial plane, in the area of the tip.

12. A mounting according to claim 10, wherein one lateral profile extends, as a straight surface, essentially in radial direction, and only the other lateral profile has an end area which is directed diagonally toward the radial plane, in the area of the tip.

13. A mounting according to claim 12, wherein the teeth are flattened in the area of the tips.

* * * * *